US005427029A

United States Patent [19]

Dumke

[11] Patent Number: 5,427,029

[45] Date of Patent: Jun. 27, 1995

[54] METHOD AND APPARATUS FOR PROVIDING PRINTED LABELS FOR LARGE NUMBERS OF OBJECTS

[75] Inventor: Robert D. Dumke, Colgate, Wis.

[73] Assignee: Professional Control Corporation, Germantown, Wis.

[21] Appl. No.: 187,589

[22] Filed: Jan. 25, 1994

[51] Int. Cl.[6] ..... B41F 23/04

[52] U.S. Cl. ..... 101/484; 400/120.18; 156/387; 156/DIG. 2; 156/542

[58] Field of Search ..... 101/483, 484; 156/384–388, 538, 540, 541, 542, 552, DIG. 1, DIG. 2, DIG. 25, DIG. 27, DIG. 58; 271/34; 400/120.02, 120.18

[56] References Cited

U.S. PATENT DOCUMENTS

| | | | |
|---|---|---|---|
| 3,513,058 | 5/1970 | Penick | 156/388 |
| 3,984,279 | 10/1976 | Siryj | 156/DIG. 2 |
| 4,172,417 | 10/1979 | Fardeau et al. | 400/126 |
| 4,181,561 | 1/1980 | Seragnoli | 156/DIG. 2 |
| 4,239,570 | 12/1980 | Kerwin | 156/DIG. 27 |
| 4,378,564 | 3/1983 | Cross et al. | 400/126 |
| 4,564,846 | 1/1986 | Siegal | 400/126 |
| 4,576,370 | 3/1986 | Jackson | 156/387 |
| 4,580,914 | 4/1986 | Rich et al. | 400/126 |
| 4,789,148 | 12/1988 | Noguchi et al. | 271/34 |
| 5,238,236 | 8/1993 | Belec et al. | 271/34 |

FOREIGN PATENT DOCUMENTS

| | | | |
|---|---|---|---|
| 1958072 | 5/1971 | Germany | 156/384 |
| 3502950 | 7/1986 | Germany | 156/387 |
| 38-92564 | 4/1963 | Japan . | |
| 1209139 | 8/1989 | Japan . | |
| 2233336 | 9/1990 | Japan | 156/DIG. 27 |
| 36612 | 2/1991 | Japan . | |
| 312541 | 2/1991 | Japan . | |
| 3286847 | 12/1991 | Japan . | |
| 489755 | 3/1992 | Japan . | |

OTHER PUBLICATIONS

"Word Perfect for IBM Personal Computers", Word Perfect Corp., pp. 15, 252, 253, 285, 286–288, 307, 294–296, 301, 302, 309, 310–311, 457, May. 31, 1988.

Label-Aire Brochure Model 2138 Printer/Applicator, QLC, Inc., Hartland, Wis., Jan. 1992.

Label-Aire Brochure Model 2111 Standard Mobile Label Applicator, QLC, Inc., Hartland, Wis., Mar. 1992.

Label-Aire Operator's Manual, 2111ST02, pp. 10–34, 84, 90–98.

Warner Electric, Service & Installation Instructions, PAC440 EPI10 Control with Indexer for Electrak 2000 Actuators.

Kodak Ink-Jet Imaging Systems Brochure, Kodak Ektajet 5000 Printer.

Kodak Ektajet 5000 Printer Operator's Manual, Kodak Ink-Jet Imaging Products, pp. I–VIII, 1-1: 1-9.

*Primary Examiner*—Eugene H. Eickholt
*Attorney, Agent, or Firm*—Quarles & Brady

[57] ABSTRACT

A printing/applicator station (10) for use in for printing labels and attaching labels to unlabeled objects (11) at a rate of at least 200 objects per minute includes conveyors (12, 13) feeding the objects (11) at a rate of at least 200 objects per minute past a labeling machine (24) that applies labels at a rate of at least 200 per minute. The objects (11) are then fed past a printing machine (15) at the rate of at least 200 per minute. A supervisory computer (16) stores information corresponding to different titles and different customers, and transmits this information over a network (17) to the printer (15), where it is printed on the labels (37) already attached to the objects. One of the conveyors (12) is oriented at an angle of approximately twenty degrees from perpendicular to the first conveyor (13) to support the objects as they are fed at high speed. This conveyor (12) is also adjustable in a direction transverse to the direction for feeding the objects, for handling objects of different thicknesses of objects, such as video tapes, CD's and cassette tapes.

12 Claims, 2 Drawing Sheets

FIG. 2
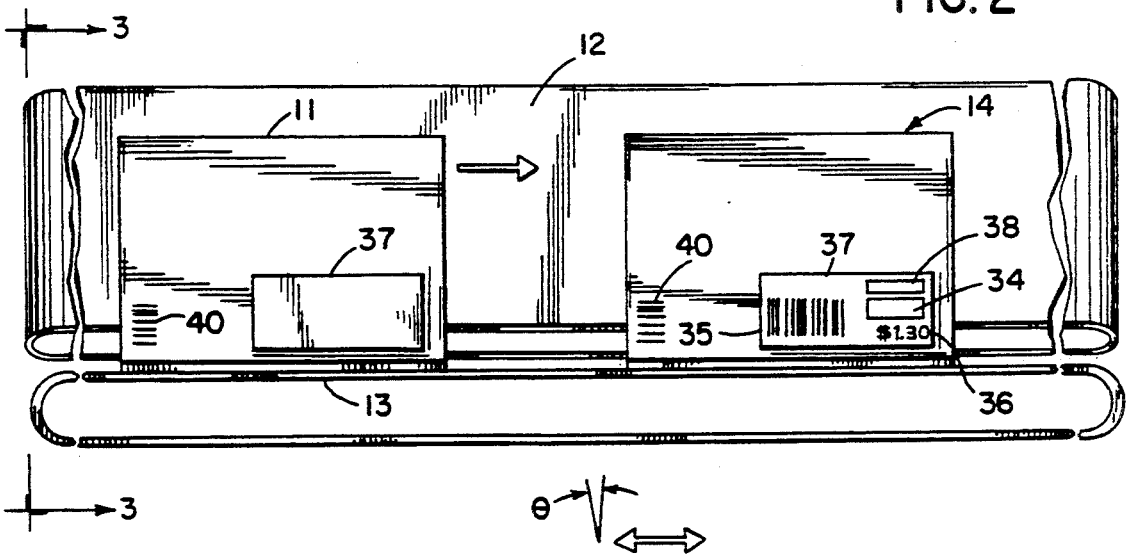
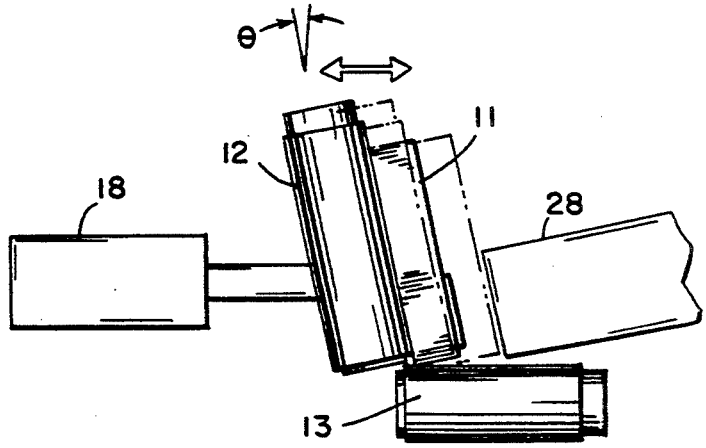
FIG. 3
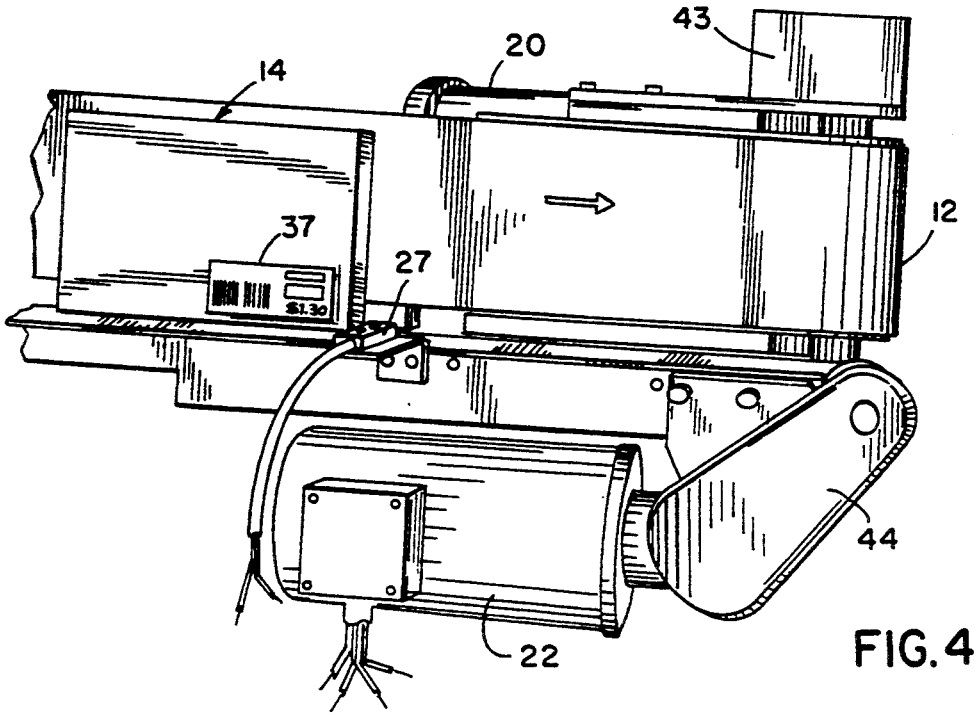
FIG. 4

METHOD AND APPARATUS FOR PROVIDING PRINTED LABELS FOR LARGE NUMBERS OF OBJECTS

TECHNICAL FIELD

The invention relates to automation methods and apparatus including methods and apparatus for providing printed labels for mass merchandise and publications.

BACKGROUND ART

High speed printers have been used in the printing industry to apply name and address information to magazines. In recent years this technology has advanced to the point where addresses and bar codes can be printed on publications for mailing.

Several machines are known for printing on labels and applying them to objects. The problem with the "print and apply" devices currently on the market is that they are relatively slow. Few exceed a practical rate of 50 parts per minute and none are known to process 100 parts or more per minute. Existing systems include self-contained units that perform both the printing step and the applying step. Printing, which is often performed by thermal transfer, is controlled by information supplied from a host (generally a computer). Once printed, a label is advanced to a position on the application portion of the device and is either blown or tamped onto the target surface. When this operation has been completed, the printer/applicator is ready to print the next label. Some companies have made these operations more efficient by making the print and apply operations concurrent. However, the data handling and mechanical nature of these devices still does not allow them to reach 100 parts per minute.

DISCLOSURE OF THE INVENTION

The invention relates to a label printer/applicator station that processes objects at rates of 200 parts per minute and greater.

The invention involves splitting the printing and applying operations into two separate operations, performed by two different devices, and reversing the usual order of accomplishing these two steps. According to the invention pieces that require labels are first fed past a labeler, where a label is applied to the object, and are then rapidly fed past the printer, which prints on labels already attached to the objects. This allows printed labels to be installed on objects at a rate in excess of 200 parts per minute and may lead to processing rates as high as 500 objects per minute.

The invention appreciates the fact that label application by itself has been reliably performed at speeds up to 300 parts per minute. But this technology has been the product of systems that require the application of preprinted labels.

The system of the invention allows application of blank or partially preprinted, non-specific labels at these higher processing rates. Unlike some systems for handling single titles of magazines in large numbers, the invention is suitable for items of the same size with different titles, as well as items of different sizes with different titles.

The use of high speed labelers and ink-jet printers requires that the target surface be ½ inch or less from the label applicator's labeling surface.

To accommodate pieces with varying widths, the invention provides conveyors for the printing/applicator station which will move to keep the target surface on the objects within a specified distance of a printer and an applicator. The orientation of the conveyors is also important in arriving at a workable system. Objects pass the printer while riding on the same conveyor that brought them past the label applicator.

Other objects and advantages, besides those discussed above, will be apparent to those of ordinary skill in the art from the description of the preferred embodiment which follows. In the description, reference is made to the accompanying drawings, which form a part hereof, and which illustrate examples of the invention. Such examples, however, are not exhaustive of the various embodiments of the invention, and, therefore, reference is made to the claims which follow the description for determining the scope of the invention.

BRIEF DESCRIPTION OF THE DRAWINGS

FIG. 2 is a detail, side elevational view illustrating the labeling and printing zone on the conveyor system of FIG. 1; and FIG. 3 is a left end view of the conveyor system taken in the plane indicated by line 3—3 in FIG. 2; and FIG. 4 is a detail side elevational view of the right end portion of the conveyor system of FIG. 1.

DETAILED DESCRIPTION OF THE PREFERRED EMBODIMENT

Figure 1:
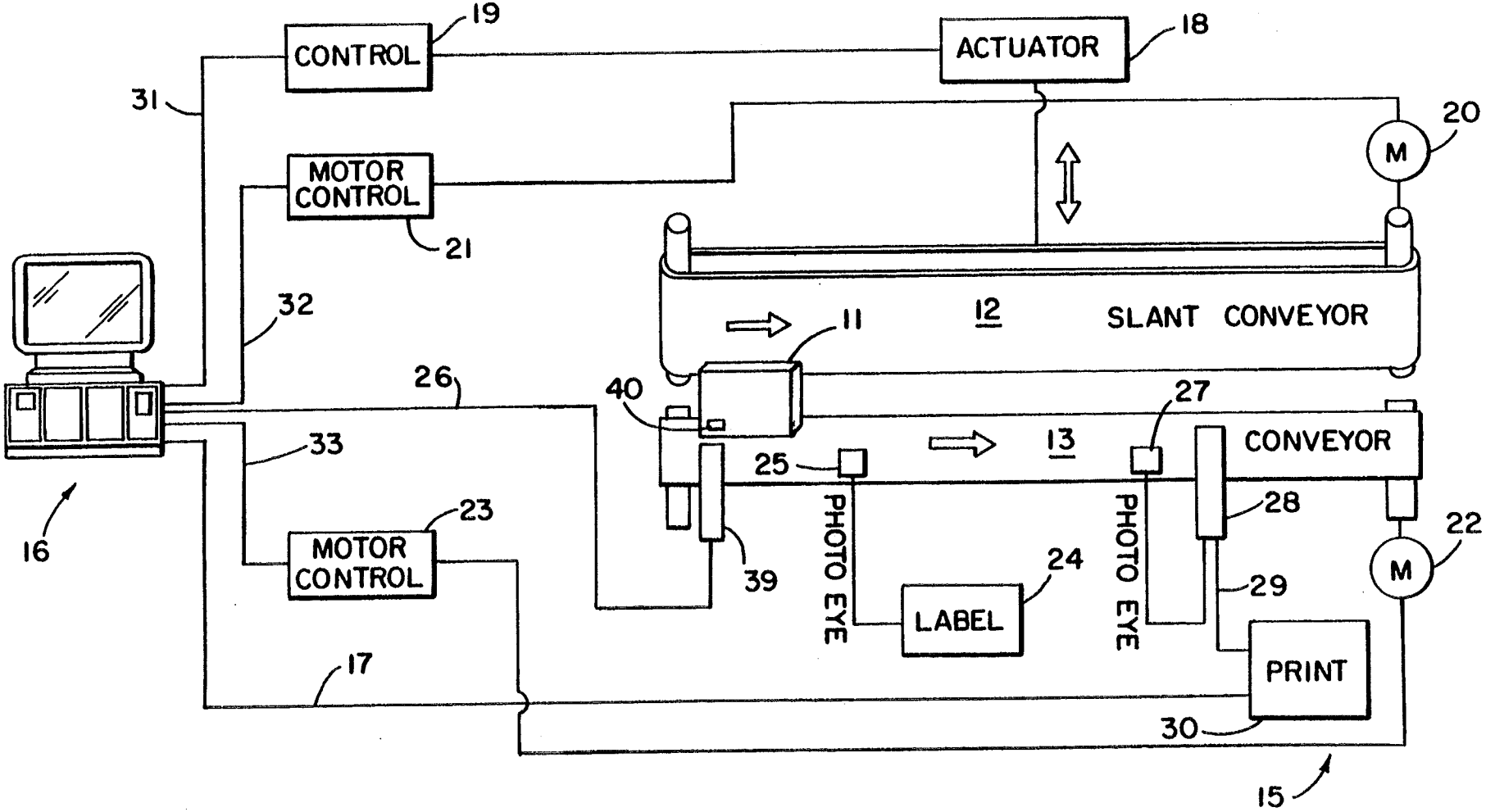
FIG. 1 is a schematic view of a conveyor system utilizing the methods and apparatus of the present invention.

FIG. 1 shows a printing and labeling station 10 of a type that utilizes the methods and apparatus of the current invention. This station 10 is utilized in distributing objects 11 such as video tapes, cassette tapes and compact disks to large numbers of customers. Typically the station 10 receives unlabeled objects 11 such as video tapes, cassette tapes or compact disks, which are fed on edge onto lower conveyor 13. Where the objects 11 are of the same footprint and thickness, a single horizontal conveyor 13 can be used. In the preferred system, which handles objects of different footprints and thicknesses, the objects are supported at an angle $\theta$ between horizontal and vertical by upper conveyor 12 (FIGS. 2 and 3). In the preferred embodiment, this angle $\theta$ is selected to be approximately twenty degrees from perpendicular to the conveyor 13 (including a range of plus or minus five degrees), which is found to be advantageous for objects of different sizes. In its broadest aspects, the invention is also applicable to objects of the same size, which could be fed on a single horizontal conveyor 13. Other arrangements of the conveyors 12, 13, for orienting the objects at positions from horizontal up to vertical (ninety degrees), are possible.

The objects 11 are unlabeled, in the sense of pricing information, however, the packaging of the objects typically contains a UPC product bar code 40 seen in FIGS. 2 and 4.

In order to save stocking costs, large retail customers desire to have stocking data applied to items in their order before they are shipped from the distribution center. The items can then be stocked without further labeling and pricing activity at the retail stores. Prior systems have been limited in automating this process.

The station 10 labels and prints the objects 11 with suitable information on title, price, stocking information and any further applicable bar codes. The labeled objects 14 exit conveyors 12, 13 (FIGS. 2 and 4) and enter a large collating/stacking station (not shown) for collating orders for up to 100 customers.

In the present invention, the customer's product specific data is entered into a computer 16 seen in FIG. 1. This data will be communicated through a serial or parallel data computer network 17 to a printing machine 15, which will print the information on labels 37 (FIG. 2) which have already been applied to the objects 11. The objects are identified by their UPC bar code 40 (FIGS. 2 and 4), which is read through bar code reader 39 in FIG. 1 and input to computer 16 through cable 26. The computer 16 becomes synchronized to the object 11 as it is fed from the bar code reader 39 to the labeler 24 and printer 15. This allows the computer 16 to correlate the customer's product specific data to the specific object 11. The customer data is then sent to the printer 15 in time to be applied to the labeled object 14.

The computer 16 also supervises control of output devices for operating the conveyors 12, 13, such as DC motors 20, 22, and stepper motor actuator 18. The computer 16 connects through a serial data network 31 to a motion controller 19 which runs the stepper motor actuator 18. The computer 16 connects through analog signal cables 32, 33 to a pair of DC motor controllers 21, 23 which runs DC motors 20, 22, operating the upper and lower conveyor respectively. Motors 20, 22 are shown with drive linkages 43, 44 (FIG. 4) which couple the motors to the conveyors 12, 13.

Referring to FIG. 1, the conveyors 12, 13 run first past a labeling machine 24, and then past the printing machine 15. These are sophisticated, electronically controlled machines. The labeling machine 24 is a Model 2111 ST manufactured and distributed by Label-Aire Incorporated and its associated distributors. The printing machine 15 is a Sytex Ektajet 5000 available from Sytex Corporation, Dayton, Ohio, USA. The labeling machine 24 includes a photo eye sensor 25 for detecting the approach of an object to be labeled.

The labeling machine 24 carries a web (not shown) that is wound around several guide rollers. The web in turn carries a number of blank labels 37 (FIGS. 2 and 4) to be applied to objects 11 as they speed by the machine. The labeling machine 24 is also capable of printing on labels, or applying preprinted labels. It is, however, the method of the present invention to apply the labels in blank, and print them later as they are fed past the printing machine 15.

The printing machine 15 (FIG. 1) includes a cabinet 30, a remote ink-jet printhead 28 and a conduit 29 for carrying cables which connect the cabinet 30 to the printhead 28. The printing machine 15 is also associated with a photo eye sensor 27 for detecting the approach of an object to be printed.

In the method of the invention objects are fed by the conveyors 12, 13 at a rate of at least two hundred objects per minute past a labeling machine 24. The labels are blown on in the characteristic manner of operating the labeling machine 24. The specifications for this machine, as contained in its Operator's Manual are followed, however, in addition, it is required that the objects 11 be fed to within one-quarter inch of the labeling portions of the machine 24. With other labeling machines it may be possible to increase this gap up to one-half inch.

The objects continue to move past photo eye 27 (FIG. 1) at a rate of at least two hundred objects per minute to the printing machine 15. Again, the specifications for this machine, as contained in its Operator's Manual are followed, however, it is required that the objects 11 be fed to within one-quarter inch of the ink-jet printhead 28 (FIG. 3). Again, with other printers, it may be possible to increase this gap up to one-half inch.

This allows printing information on the labels 37 already attached to said objects 11 at the rate of two hundred printing operations per minute.

The information that is printed on the labels 37 (FIG. 2) typically includes the title 34, a bar code 35, the price 36 and miscellaneous stocking information 38. The bar code 35 is a second bar code on the product, which is in addition to the UPC bar code 40 on the packaging of the objects 11.

The stepper motor actuator 18 allows the upper conveyor 13 (FIG. 3) to be moved laterally, so that the one-quarter inch limitation can be maintained for objects of different thicknesses. For example, a cassette tape has a different thickness than a compact disk (CD), and a video tape is thicker than either a cassette tape or CD.

With such a printing/labeling station under control of computer 16, orders can be processed for up to 100 customers, including large retail chains ordering many titles and small customers ordering just a few titles.

All of the objects for one title are processed for all customers in one series. The customer information is transmitted to the printer 15 which applies it to different objects 11 of the same title, which are then sorted by customer at the sorting/collating station. The same titles ordered by different customers may have different prices printed on them.

Next, the objects of a second title are processed for all customers. Those customers that ordered one or more of both titles will have both titles included in their order.

After a number of titles have been processed the orders are removed from the machine and shipped.

This has been a description of examples of how the invention can be carried out. Those of ordinary skill in the art will recognize that various details may be modified in arriving at other detailed embodiments, and these embodiments will come within the scope of the invention.

Therefore, to apprise the public of the scope of the invention and the embodiments covered by the invention, the following claims are made.

I claim:

1. A method for attaching labels and printing labels on objects at a rate of at least two hundred objects per minute comprising:

feeding objects past a reading device for identifying the objects;

transferring data identifying the objects from the reading device to a computer;

feeding objects at a rate of at least two hundred objects per minute past a labeling machine, the objects being fed to within one-half inch or less of the labeling machine;

applying blank or partially-printed labels to the objects as said objects are fed by the labeling machine;

continuing the feeding of objects at a rate of at least two hundred objects per minute past a printing machine, said objects being fed to within one-half inch or less of the printing machine;

printing information on the labels already attached to said objects at the rate of two hundred printing operations per minute as said objects are fed by a printhead on the printing machine, said objects being fed to within one-half inch or less of the printhead, said information being based on identity of the objects detected by the reading device and in response to customer ordering data received from the computer.

2. The method of claim 1, further comprising transmitting customer ordering data corresponding to different titles from the computer to the printing machine; and printing the customer ordering data corresponding to different titles on successive objects of the same size.

3. The method of claim 1, further comprising transmitting customer ordering data corresponding to different customers from the computer to the printing machine; and printing the customer ordering data corresponding to different customers on successive objects of the same size.

4. A method for attaching labels and printing labels on objects at a rate of at least two hundred objects per minute comprising:

feeding objects at a rate of at least two hundred objects per minute past a labeling machine, the objects being fed to within one-half inch or less of the labeling machine;

applying labels to the objects as said objects are fed by the labeling machine;

continuing the feeding of objects at a rate of at least two hundred objects per minute past a printing machine, said objects being fed to within one-half inch or less of the printing machine;

printing information on the labels already attached to said objects at the rate of two hundred printing operations per minute as said objects are fed by a printhead on the printing machine, said objects being fed to within one-half inch or less of the printhead, and further comprising supporting and feeding the objects with two conveyors, a first conveyor being disposed horizontally and a second conveyor extending alongside said first conveyor to support objects being fed along said first conveyor, said second conveyor being disposed at an angle to the first conveyor, said angle being between horizontal and vertical.

5. The method of claim 4, wherein the second conveyor is disposed at an angle of approximately twenty degrees from perpendicular to the first conveyor.

6. The method of claim 4, further comprising adjusting location of the second conveyor in a direction transverse to a direction for feeding the objects, to maintain the distance between objects and the labeling machine and printing machine to within one-half inch or less.

7. A printing/applicator station for attaching labels and printing labels on objects at a rate of at least two hundred objects per minute, the station comprising:

a computer for receiving data identifying the objects and for transmitting corresponding customer-specific data for printing on the objects;

a reading device for identifying objects to the computer;

conveyor means for feeding objects at a rate of at least two hundred objects per minute past the reading device and a labeling machine, the conveyer means being located relative to the labeling machine such that objects are fed to within one-half inch or less of the labeling machine;

a labeling machine that applies blank or partially printed labels to the objects at a rate of at least two hundred labels per minute;

a printing machine having a printhead;

wherein the conveyor means extends past the printing machine, said objects being fed at a rate of at least two hundred objects per minute to within one-half inch or less of the printhead; and wherein the printing machine prints customer-specific data received from the computer on the labels already attached to the objects as they are fed by the printing machine at a rate of at least two hundred objects per minute, said information varying between different objects according to the customer-specific data and the respective identities of the objects detected through the reading device.

8. The station of claim 7, wherein the computer stores customer-specific data corresponding to different titles of objects, including means for transmitting information corresponding to different titles to the printer; and wherein the printer prints the information corresponding to different titles on successive objects of the same size.

9. The station of claim 7, wherein the computer stores customer-specific data corresponding to different customers for the objects, including means for transmitting the customer-specific data corresponding to different customers to the printer; and wherein the printer prints the customer-specific data corresponding to different customers on successive objects of the same title.

10. A printing/applicator station for attaching labels and printing labels on objects at a rate of at least two hundred objects per minute, the station comprising:

conveyor means for feeding objects at a rate of at least two hundred objects per minute and a labeling machine, the conveyor means being located relative to the labeling machine such that objects are fed to within one-half inch or less of the labeling machine;

a labeling machine that applies blank or partially printed labels to the objects at a rate of at least two hundred labels per minute;

a printing machine having a printhead;

wherein the conveyor means extends past the printing machine, said objects being fed at a rate of at least two hundred objects per minute to within one-half inch or less of the printhead; and wherein the printing machine prints on the labels already attached to the objects as they are fed by the printing machine at a rate of at least two hundred objects per minute, said information varying between different objects;

wherein the conveyor means includes first and second conveyors, said first conveyor being oriented horizontally and said second conveyor extending alongside said first conveyor to support objects being fed along said first conveyor, said second conveyor being oriented at an angle between horizontal and vertical.

11. The station of claim 10, wherein said second conveyor is oriented at an angle of approximately 20 degrees from perpendicular to said first conveyor.

12. The station of claim 10, further comprising means for adjusting the location of the second conveyor in a direction transverse to a direction for feeding the objects to maintain the distance between objects and the labeling machine and printhead to within one-half inch or less.

* * * * *